United States Patent [19]

Perrin

[11] 4,164,306

[45] Aug. 14, 1979

[54] SOAP DISPENSER INCLUDING REMOVABLE SOAP SUPPLY CONTAINER POSITIONER AND STABILIZER

[75] Inventor: Jack L. Perrin, Los Angeles, Calif.

[73] Assignee: Towlsaver, Inc., City of Industry, Calif.

[21] Appl. No.: 892,882

[22] Filed: Apr. 3, 1978

[51] Int. Cl.[2] ..... B67D 5/06

[52] U.S. Cl. ..... 222/181; 222/325; 248/311.3; 141/375

[58] Field of Search ..... 222/173, 179.5, 180, 222/181, 185, 325; 221/282, 283; 239/282, 283; 248/311.3, 311.1, 316 D, 221.3; 141/375

[56] References Cited

U.S. PATENT DOCUMENTS

| | | | |
|---|---|---|---|
| 2,893,678 | 7/1959 | Homan et al. | 248/311.3 |
| 3,096,913 | 7/1963 | Cotley | 222/181 |
| 3,178,061 | 4/1965 | Giacalone et al. | 248/311.1 |
| 3,540,630 | 11/1970 | Brown et al. | 222/181 |
| 3,613,958 | 10/1971 | Opp | 222/180 |
| 3,912,125 | 10/1975 | Acklin | 222/181 |
| 4,036,406 | 7/1977 | Jespersen et al. | 222/181 |

*Primary Examiner*—Robert J. Spar
*Assistant Examiner*—H. Grant Skaggs
*Attorney, Agent, or Firm*—Mahoney, Schick & Cislo

[57] ABSTRACT

A frame including a vertically pivotal cabinet mounts a dispensing mechanism selectively operable by an actuating lever for dispensing liquid soap therefrom. The main soap supply is provided by an inverted container which is rearwardly vertically pivoted into and forwardly pivoted from a soap supplying position when the cabinet is open. At least one forward cylindrical projection on the frame slidably pressure abuts facing vertical surfaces within a back wall recess of the container during pivotal insertion into and while the container is in the soap supplying position, the projection and recess preferably being horizontally offset relative to the container vertical centerline, all to positively locate and stabilize the container in the dispenser.

7 Claims, 9 Drawing Figures

SOAP DISPENSER INCLUDING REMOVABLE SOAP SUPPLY CONTAINER POSITIONER AND STABILIZER

BACKGROUND OF THE INVENTION

This invention relates to a soap dispenser of the type for dispensing flowable soap therefrom for instance, liquid soap and the like. More particularly, this invention relates to that type of soap dispenser having the main soap supply provided by a removable container which may be inserted into a soap supplying position within the dispenser and may be removed therefrom when the soap supply therein is exhausted for replacement by that or another container having a replenished soap supply therein. According to the principles of the present invention, the improvements include in such general combination, means for positively locating the container within the dispenser during container insertion into and while the container is in the soap supplying position, a more particular specific embodiment preferably also including added stabilizing for the container during such insertion and soap supplying positioning.

Various forms of soap dispensers for dispensing flowable soap have heretofore been provided and although certain of these prior soap dispensers have made use of granular soap, the most prevalent type is that dispensing liquid soap. In any event, even though various of the prior soap dispensers have been installed in the kitchens and bathrooms of homes, they are considered virtually indispensable in public and industrial washrooms. As applied to public and industrial washrooms, an individual washroom may include only one or two, but frequently includes relatively large numbers thereof which must be kept serviced with replenished soap supplies by the maintenance personnel charged with such duties. Thus, maintenance servicing of these soap dispensers is a factor of important consideration.

Certain of the soap dispensers of the type herein involved include a permanently assembled or mounted soap reservoir therein or thereon which contains the quantity of soap supply directed to a particular dispensing device and to be dispensed from the particular dispenser. Servicing of these dispensers with the permanently mounted reservoirs for refilling the same is accomplished by the individual pouring from a larger container into each of the individual reservoirs. This individual filling operation obviously requires some dexterity and care, and even then usually must be followed by a certain amount of cleaning to remove soap that is unavoidably spilled.

Since the advent of modern, economical plastics, it has become quite common to provide soap dispensers of the class and use hereinbefore described with removable and replaceable plastic containers, each serving as selectively removable main soap supply reservoir in each individual dispenser. The soap-filled individual containers are transported by the maintenance personnel to the site of each of the soap dispensers involved and usually by the mere opening of a dispenser cabinet, the empty plastic container of the dispenser is exposed for ready removal and replacement by the soap-filled container with a reclosing of the dispenser cabinet completing the soap supply replenishing operation. Thus, the replenishment of the dispenser soap supplies is much more conveniently accomplished so as to eliminate many of the problems of the dispensers having the permanently mounted soap supply reservoirs and the dispenser individual plastic containers, now empty, may be transported to a central location for discarding or refilling.

Although this removable, individual, soap supply container concept has proved to be quite satisfactory and does eliminate, or at least greatly simplify, the soap supply replenishment maintenance problems, certain difficulties with the prior constructions still persist and require solutions. One major consideration is that coupled with the fact that the removable plastic containers must be easily and conveniently insertable into and removable from their soap supplying positions within the dispensers, there is the important requirement of retaining compactness of the overall dispensers so that they are not only asthetically pleasing, but are not prohibitive in size. However, for maximum compactness, the removable plastic containers must be of particular shapes and contours smoothly fitting into and blending with the other components of the dispenser.

The consequences of this compactness requirement resulting in the removable containers of somewhat irregular and specifically adapted shapes is that the containers are only insertable into their soap supplying positions and removable therefrom in a single predetermined position, many times requiring a predetermined pivotal motion of the container during insertion and the opposite pivotal motion for removal. If a particular container is attempted to be inserted into the dispenser into a wrong position, the proper soap supply connection to the dispenser dispensing mechanism will not be properly established and, in many cases, the dispenser cabinet cannot be closed to place a dispenser in a properly operable condition. Thus, there must be some means integrated into the particular container shape absolutely requiring the maintenance personnel to properly insert the container into their proper soap supplying positions and this requirement to avoid maintenance difficulties has not been considered in many of the prior constructions.

In addition, even if a container is inserted into its dispenser while initially properly positioned, there is still the further problem of finally locating the container at the end of the inserting motion into its exact, compact soap supplying position relative to the dispenser dispensing mechanism to be supplied. Slight misalignments or variations in such container final positioning can result in lack of proper soap flow between the supplying container and the dispensing mechanism being supplied. Furthermore, in addition to this exact locating of the container into and in its final soap supplying position, it is also highly advantageous to provide final positive stabilization of the container in its soap supplying position for added insurance that the dispenser components will always remain properly coupled for a continued successful soap supplying and dispensing operation. Again, these various considerations have been lacking in the prior constructions.

OBJECTS AND SUMMARY OF THE INVENTION

It is, therefore, an object of this invention to provide a soap dispenser including a removable soap supply container wherein the dispenser and container are each specifically formed and combined to provide exact positioning and locating means positively insuring that the container must be brought into a precise soap supplying position during the final stages of the insertion thereof.

With this positive positioning and locating means, there is a constant visual indication for maintenance personnel at the beginning of the inserting movement indicating a proper starting positioning of the container. Furthermore, with this positioning and locating means, unless the container is properly initially positioned at the start of the inserting operation, it simply cannot be finally brought into its proper soap supplying position at normal termination of the inserting operation, all of which will be clearly obvious to the maintenance personnel. Thus, despite the compactness requirements and, in many cases, the special insertion motion requirements as hereinbefore discussed, complete assurance is provided for a successful container insertion and positioning operation.

It is a further object of this invention to provide a soap dispenser including a removable soap supply container wherein the above discussed unique positioning and locating means may be specifically formed to, in addition to the pure positioning and locating function, provide a moderate degree of stabilization for the container in its final soap supplying position. In such somewhat more sophisticated form, the cooperable container and dispenser elements combining to form the unique positioning and locating means may be specifically positioned and formed so that ultimately adjacent facing surfaces thereof come into at least an abutting positioning relationship during the final inserting stages and in the ultimate container soap supplying position. Therefore, in addition to the positioning and locating functional features, the cooperable means of the container and dispenser provide a moderate degree of stabilization for the container in its important soap supplying position aiding in preventing the container from becoming either slightly dislodged or misaligned after its soap supplying positioning which could, again, cause malfunctioning of the dispenser during use including an improper flowable soap supply.

It is still a further object of this invention to provide a soap dispenser including a removable soap supply container wherein the above discussed positioning and locating means of the container and dispenser will, in its optimum form, not only provide the positioning and locating of the container during and after the insertion thereof into its soap supplying position, but will also create positive pressure engaging abutment between the container and dispenser to insure positive stabilization of the container in its soap supplying position. This positive stabilizing force functioning is brought into play by the provision of slidably pressure abutting surfaces of the positioning and locating means preferably including aligned and spaced surfaces on each of the container and dispenser. During the later stages of the container insertion and ultimately when the container is stationary in its final soap supplying position, these facing abutting surfaces slidably pressure engage in slidable abutting relationship so as to positively stabilize the container as it finally moves into and is retained in its soap supplying position so as to eliminate any possibility of misalignments or unintended dislodgement during the dispenser functioning.

Other objects and advantages of the invention will be apparent from the following specification and the accompanying drawings which are for the purpose of illustration only.

DESCRIPTION OF THE BEST EMBODIMENT CONTEMPLATED

Referring to FIGS. 1 through 7 of the drawings, a preferred embodiment of a flowable soap dispenser is shown incorporating the positioning and stabilizing improvements of the present invention for the removable soap supply container. The dispenser is preferably a liquid soap dispenser and is wall-mounted. Furthermore, the soap dispenser including the various components thereof may be fabricated of usual materials and by usual manufacturing processes except as hereinafter specifically pointed out. It should be understood, however, that the improvements of the present invention are applicable to many forms of flowable soap dispensers incorporating removable soap supply containers therein and that it is not intended to limit the principles of the present invention to the exact embodiment or embodiments shown, rather, the principles of the present invention should be liberally construed and not limited beyond the specific limitations set forth in the appended claims.

Figure 1:
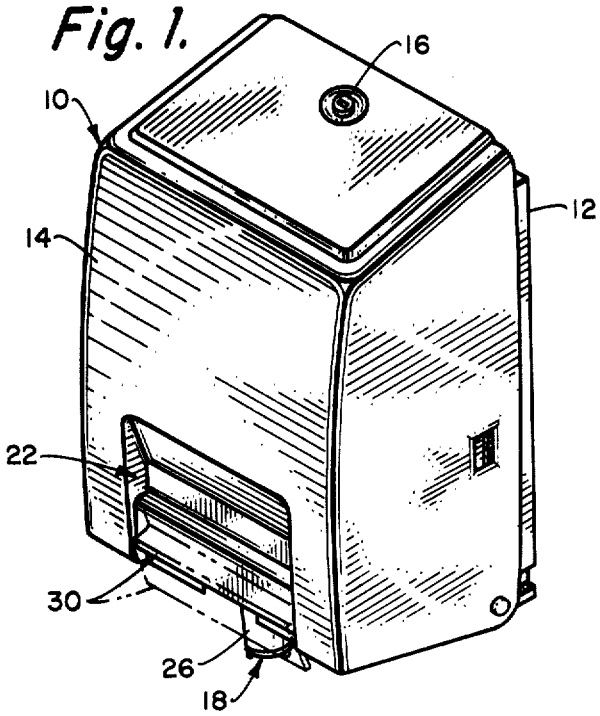
FIG. 1 is a perspective view of a preferred embodiment of a flowable, preferable liquid, soap dispenser in normal, selectively operable soap dispensing position and incorporating the improvements of the present invention, a dispensing or operating lever thereof being shown moved downwardly in a dispensing stroke in phantom lines.
Figure 2:
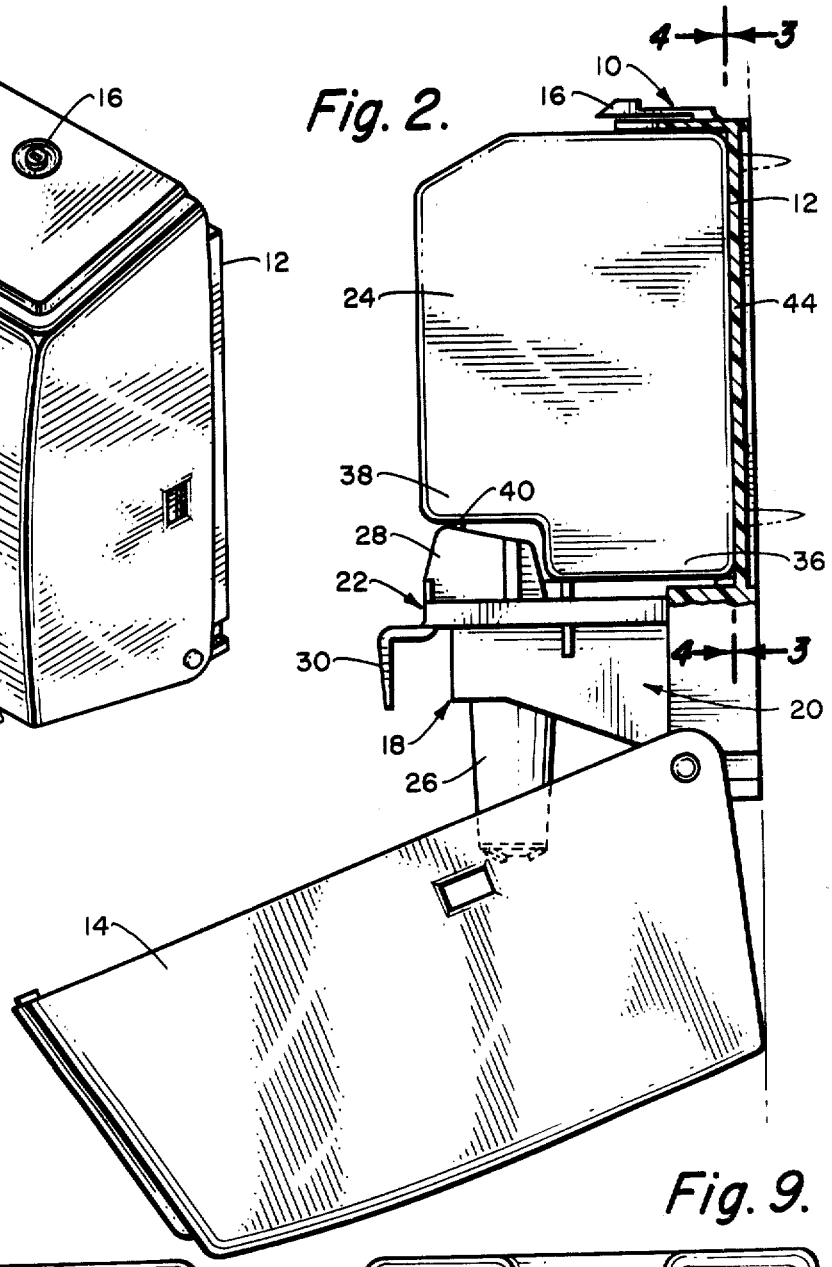
FIG. 2 is a side elevational view, part in vertical section, of the dispenser of FIG. 1 with a cabinet thereof pivoted generally vertically downwardly to an open position exposing the interior components of the dispenser.
Figure 5:
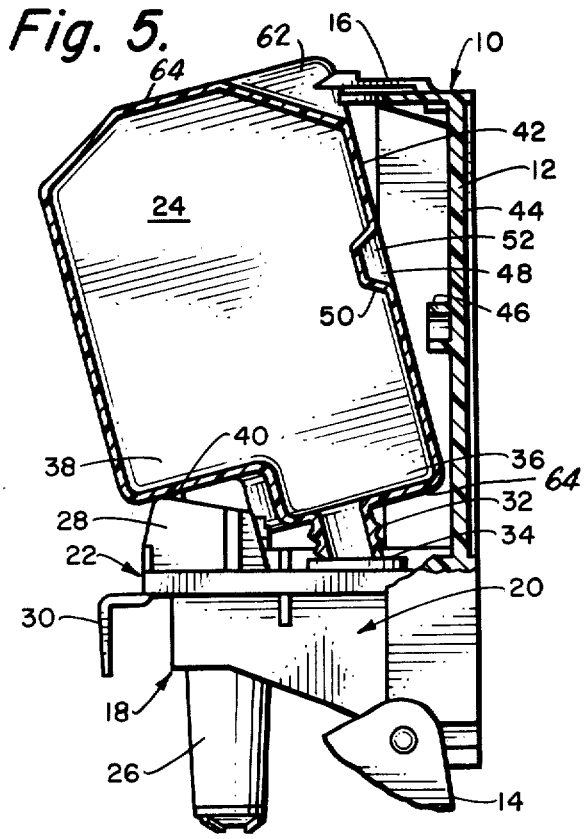
FIG. 5 is a fragmentary, vertical sectional view looking in the direction of the arrows 5—5 in FIG. 3 and showing the removable, main soap supply container of the dispenser intermediate insertion into or removal from a soap supplying position within the container.

Providing the background environment for the container positioning and stabilizing improvements, the dispenser includes a frame generally indicated at 10 comprised of a wall-mounted, stationary frame portion 12 and a rearwardly opening, box-like, hollow cabinet 14 which is pivoted on the stationary frame portion for hinged movement between an upper closed position as shown in FIG. 1 and a downward open position as shown, for instance, in FIGS. 2 and 5. The cabinet 14 as retained in its closed position by any usual form of selectively releasable latch 16. Furthermore, when in its closed position, the cabinet 14 encloses the main portions of a dispensing mechanism generally indicated at 18, a soap reservoir sump generally indicated at 20 and a selectively pivotal dispensing or actuating lever generally indicated at 22, as well as substantially entirely encloses a removable main soap supply container generally indicated at 24.

The dispensing mechanism 18 has a dispensing nozzle 26 which projects downwardly through an appropriate opening of the cabinet 14 when the cabinet is in closed position, the opening being formed such as to permit the opening movement of the cabinet as described. Adjacent the upper end of the dispensing nozzle 26, the dispensing mechanism 18 is integrally connected rearwardly to the soap reservoir sump 20 which, in turn, is secured rearwardly to the stationary frame portion 12 so as to support both the dispensing mechanism and sump on the frame 10. The actuating lever 22 is vertically pivotally connected to the stationary frame portion 12 and projects generally horizontally forwardly adjacent and straddling the unitary sump 20 and dispensing mechanism 18 with an actuating portion 28 formed upwardly over and to downwardly engage the dispensing mechanism, and with a forward hand engaging portion 30 projecting forwardly from the closed cabinet opening.

Thus, when a supply of liquid soap is maintained in the sump 20, the sump provides a constant supply for the dispensing mechanism 18. The actuating lever 22 is normally in an upper "at rest" position as shown in FIGS. 2 and 5, but when the actuating lever is pivoted downwardly toward the dispensing mechanism 18 by hand engagement with the lever forward portion 30, the dispensing mechanism is actuated causing a dispensing of soap from the lower end of the dispensing nozzle 26. The release of downward pressure against the actuating lever 22 permits the lever to return upwardly to its "at rest" position and the dispensing mechanism 18 to be refilled automatically with soap from the sump 20 preparatory to the next lever dispensing stroke.

The soap reservoir sump 20 is maintained with a full supply of soap by the main soap supply container 24, the container preferably being formed of plastic and being specifically shaped adapted for the particular dispenser. When positioned stationary within the dispenser in soap supplying position as shown in FIG. 2, the container 24 is inverted with a specifically located, usual threaded nozzle 32 thereof (FIG. 5) extending downwardly through a sump opening 34. The container threaded nozzle 32 is formed on a rearward projecting portion 36 of the container 24 which rests on parts of the sump 20 with a forward recessed portion 28 of the actuating lever 22. The recessed portion 38 is supported downwardly by a pair of stationary pins 40 which project upwardly from the dispensing mechanism 18 through the actuating lever 22. Otherwise, the container 24 in this soap supplying position fits closely within the stationary frame portion 12, a container rear vertical wall 42 laying forwardly adjacent a rear vertical part 44 of the stationary frame portion.

Thus, with the cabinet 14 pivoted downwardly to its open position as shown in FIG. 2, the main soap supply container 24 may be rearwardly, generally vertically pivoted into or forwardly, generally vertically pivoted out of its dispenser installed soap supplying position. As shown in FIG. 5, the container 24 is intermediate its pivotal motion either into or from its soap supplying position and as can be seen, such pivoting is over the stationary pins 40 permitting it to move pivotally into and from such position. At the same time, the pivotal supporting of the container 24 by the stationary pins 40 prevents any possibility of the container accidentally depressing the actuating lever 22 therebeneath which could cause an inadvertent lever depressing and soap dispensing. Furthermore, as particularly seen in FIGS. 3 and 5, a container clearance recess 62 opens upwardly from a now upper of container vertical extremities 64 spaced midway between container horizontal extremities 66 for providing clearance for the stationary frame latch 16 during pivoting of the container 24.

Figure 3:
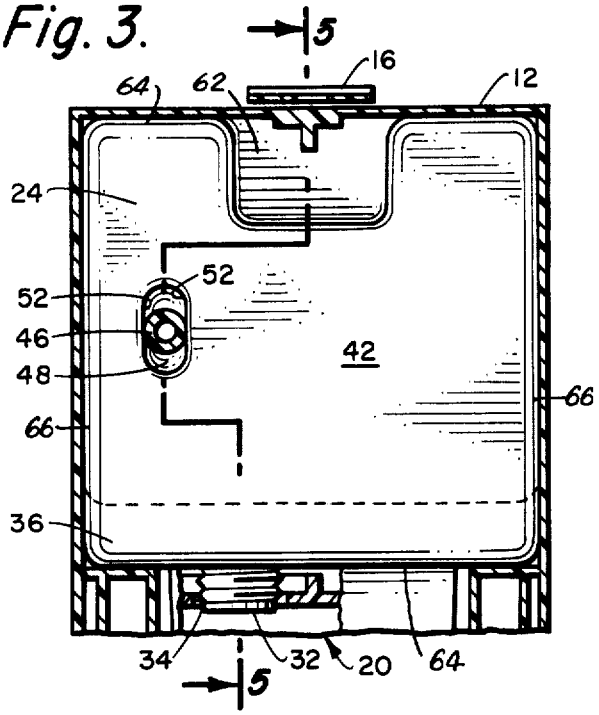
FIG. 3 is a fragmentary, vertical sectional view looking in the direction of the arrows 3—3 in FIG. 2.
Figure 6:
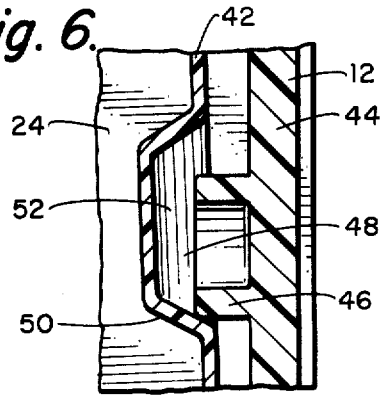
FIG. 6 is an enlarged, vertical sectional view taken from FIG. 5 and showing the container just beginning to finally enter its soap supplying position in the dispenser.
Figure 7:
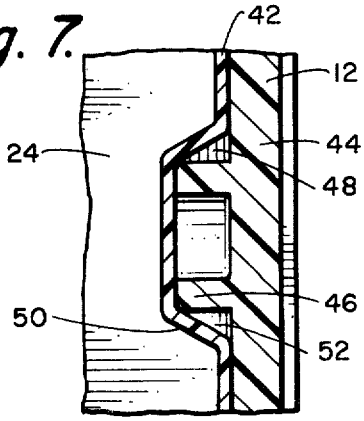
FIG. 7 is a view similar to FIG. 6, but with the container fully in its final soap supplying position in the dispenser.

More particularly to the improvements of the present invention, as best seen in FIGS. 3 through 7, a preferably hollow cylindrical, generally horizontal projection 46 is secured extending a determined distance forwardly from the rear vertical part 44 of the stationary frame portion 12. This frame portion horizontal projection 46 is specifically located predicated to be received in a generally horizontal positioning recess 48 formed in the rear vertical wall 42 of the container 24 when the container is rearwardly pivotally moved into its soap supplying position, the positioning recess 48 being spaced downwardly from the clearance recess 62 as well as spaced from all of the container vertical and horizontal extremities 64 and 66. As can be seen in FIG. 6, particularly lower wall 50 of the container horizontal positioning recess 48 angles downwardly toward the outer extremities of the recess to provide the exact clearance required for the frame portion horizontal projection 46 to smoothly enter the recess as the container 24 is brought into its final stationary soap supplying position, the final relative position being shown in FIG. 7. Furthermore, as shown in FIG. 3, spaced sidewalls 52 within the container horizontal positioning recess 48 horizontally oppositely slidably abuttingly engage, preferable pressure abuttingly engage, the frame portion horizontal projection 46 as the container 24 is brought into and positioned in its soap supplying position.

Figure 4:
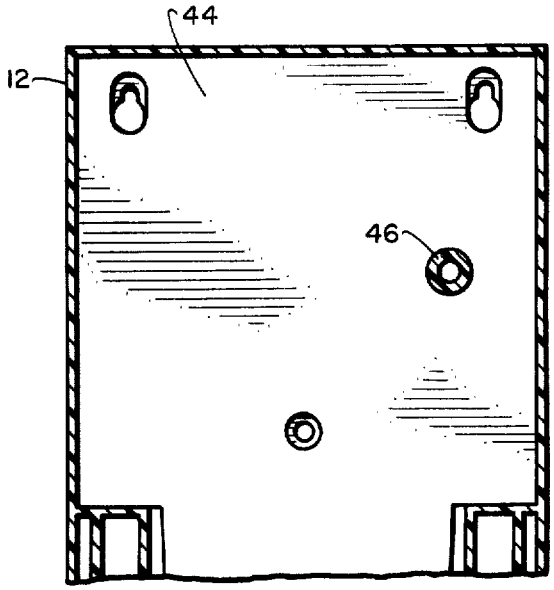
FIG. 4 is a fragmentary, vertical sectional view looking in the direction of the arrows 4—4 in FIG. 2.

In addition to all of the foregoing, it is preferred to form the specifically located frame portion projection 46 and its mating container recess 48 horizontally offset from the vertical centerline of the frame 10 and the container 24, again as shown in FIGS. 3 and 4. This offset positioning adds to the positive location of the container 24 relative to the frame 10 as the container is pivoted rearwardly into its final soap supplying position. Obviously, not only must the container 24 be pivotally aligned vertically as it is brought into its final soap supplying position in order that the frame portion projection 46 will smoothly and precisely enter into the container recess 48, but the container must be properly horizontally aligned so that the container dispensing nozzle 26 will first properly locate in the sump opening 34 and then the projection and recess will be horizontally aligned.

The overall result, therefore, is that with the dispenser frame portion projection 46 and its closely matching container recess 48, the container 24 is specifically located in its relative positioning in virtually all horizontal and vertical directions as it is being moved into and when it is in its proper soap supplying position, otherwise it cannot be brought into such soap supplying position. The angled or sloped recess lower wall 50 within the recess 48 positively requires proper alignment vertically and the horizontally spaced, vertical sidewalls 52 within the recess 48 require exact horizontal alignment. Still further, with at least slidable abutting engagement between the frame projection 46 and the recess sidewalls 52, at least a moderate degree of stabilization is given to the container 24 in its final soap supplying position, and where slidable pressure abutting engagement is provided, such stabilization is even further augmented, insuring that the container 24 will be maintained stabilized and aligned throughout its use in its soap supplying position.

Figure 8:
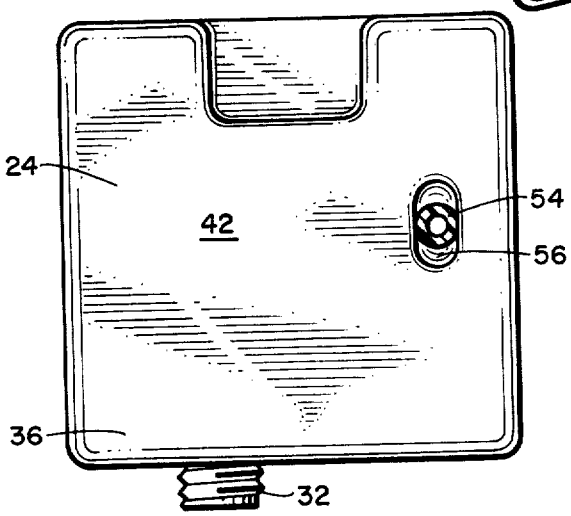
FIG. 8 is a view similar to FIG. 3, but of a second preferred embodiment incorporating the principles of the present invention.
Figure 9:
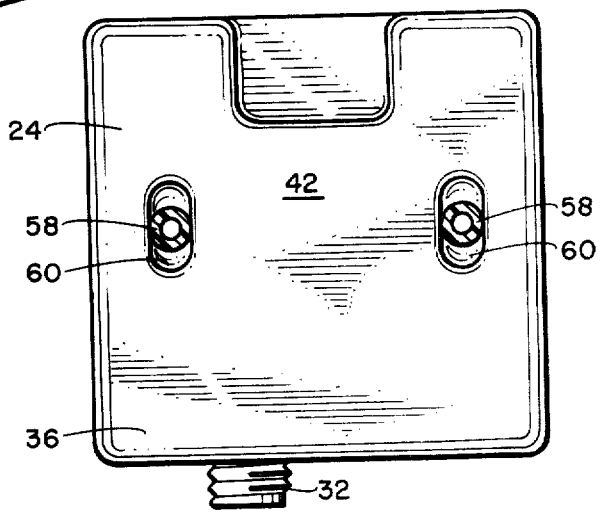
FIG. 9 is a view similar to FIG. 8, but of a third preferred embodiment incorporating the principles of the present invention.

In the second embodiment form shown in FIG. 8, a similar frame portion horizontal projection 54 and a similar container horizontal positioning recess 56 are merely horizontally offset at an opposite side of the frame 10 and the container 24, and in the third embodiment form shown in FIG. 9, pairs of frame portion horizontal projections 58 and mating pairs of container horizontal positioning recesses 60 are horizontally offset at opposite sides. These are merely alternate forms and in all cases the projections and recesses may be formed and aligned as hereinbefore described. It is pointed out that with the provision of the projections 58 and matching recesses 60 in pairs in the third embodiment form shown in FIG. 9, even greater location and stabilization for the container 24 is supplied.

I claim:

1. In a dispenser for dispensing flowable soap and the like, said dispenser being of the type having a frame mounting a dispensing mechanism operable for dispensing soap therefrom and a container in communication with said dispensing mechanism in a soap supplying position adjacent a generally vertical frame part directing a soap supply to said dispensing mechanism, said container being selectively vertically pivotally removable from and oppositely vertically pivotally insertable into said soap supplying position and said communication with said dispensing mechanism for removal of said container upon exhaustion of said soap supply therein and insertion replacement in said soap supplying position with a container having a replenished soap supply; the combination of: upper extremity clearance recess means on said container and opening upwardly for providing clearance for forwardly extending portions of said dispenser frame during said container vertical pivoting to and from said soap supplying position; a generally horizontal projection on said dispenser generally vertical frame part projecting forwardly of a rear vertical part of said frame part; generally horizontal positioning recess means on a generally vertical back wall of said container spaced from all of said clearance recess means and vertical and horizontal extremeties of said container, said positioning recess means being located for receiving said frame part projection therein during said pivotal insertion of said container into said soap supplying position and permitting said pivotal removal of said frame part projection therefrom during removal of said container from said soap supplying position, thereby locating said container in said soap supplying position, said container positioning recess means having horizontally spaced and generally vertically extending surfaces therein facing said dispenser horizontal projection to aid in said container locating in said soap supplying position.

2. In a dispenser as defined in claim 1 in which said vertically extending surfaces within said container positioning recess means oppositely abut said dispenser horizontal projection when said container is in said soap supplying position to aid in stabilizing said container in said soap supplying position.

3. In a dispenser as defined in claim 1 in which said vertically extending surfaces within said container positioning recess means oppositely horizontally pressure abut said dispenser horizontal projection during said insertion of said container into and during said container being in said soap supplying position to pressure stabilize said container in said soap supplying position.

4. In a dispenser as defined in claim 1 in which said dispenser horizontal projection and said container positioning recess means are horizontally offset from a vertical center line of said container when said container is in said soap supplying position.

5. In a dispenser as defined in claim 1 in which a lower wall within said container positioning recess means angles downwardly toward outer extremities of said container positioning recess means providing exact clearance for said dispenser horizontal projection during said container pivotal insertion into and from said soap supplying position.

6. In a dispenser as defined in claim 1 in which said dispenser horizontal projection and said container positioning recess means are horizontally offset from a vertical center line of said container when said container is in said soap supplying position; and in which said vertically extending surfaces within said container positioning recess means oppositely abut said dispenser horizontal projection when said container is in said soap supplying position to aid in stabilizing said container in said soap supplying position.

7. In a dispenser as defined in claim 1 in which said dispenser horizontal projection and said container positioning recess means are horizontally offset from a vertical center line of said container when said container is in said soap supplying position; and in which said vertically extending surfaces within said container positioning recess means oppositely horizontally pressure abut said dispenser horizontal projection during said insertion of said container into and during said container being in said soap supplying position to pressure stabilize said container in said soap supplying position.

* * * * *